US011332928B2

(12) United States Patent
Jimenez Sarta

(10) Patent No.: US 11,332,928 B2
(45) Date of Patent: May 17, 2022

(54) PANEL OF COMPOUND SHEETS FOR THE CONSTRUCTION OF LIGHT-WEIGHT ONE-WAY JOIST SLABS

(71) Applicant: SOLUCIONES E INNOVACIONES ESTRUCTURALES S.A.S., Barranquilla (CO)

(72) Inventor: Carlos Jimenez Sarta, Barranquilla (CO)

(73) Assignee: SOLUCIONES E INNOVACIONES ESTRUCTURALES S.A.S., Barranquilla (CO)

( * ) Notice: Subject to any disclaimer, the term of this patent is extended or adjusted under 35 U.S.C. 154(b) by 0 days.

(21) Appl. No.: 16/093,936

(22) PCT Filed: Mar. 24, 2017

(86) PCT No.: PCT/IB2017/051709
§ 371 (c)(1),
(2) Date: Feb. 25, 2019

(87) PCT Pub. No.: WO2017/199107
PCT Pub. Date: Nov. 23, 2017

(65) Prior Publication Data

US 2019/0177974 A1 Jun. 13, 2019

(30) Foreign Application Priority Data

May 16, 2016 (CO) ..... 16128043

(51) Int. Cl.
*E04B 5/04* (2006.01)
*E04B 5/02* (2006.01)
(Continued)

(52) U.S. Cl.
CPC ..... *E04B 5/04* (2013.01); *E04B 5/02* (2013.01); *E04C 2/28* (2013.01); *E04C 2/322* (2013.01);
(Continued)

(58) Field of Classification Search
CPC . E04B 5/02; E04B 5/026; E04B 5/023; E04B 2103/02; E04B 2103/06; E04B 5/04; E04C 2/322; E04C 2/32; E04C 2/38
See application file for complete search history.

(56) References Cited

U.S. PATENT DOCUMENTS 1,867,433 A 7/1832 Young
4,125,977 A * 11/1978 Michlovic ..... E04B 5/10 52/220.4
(Continued)

FOREIGN PATENT DOCUMENTS

CA 2289234 A1 * 5/2001 ..... E04C 2/322
CN 201424725 Y 3/2010
(Continued)

*Primary Examiner* — Christine T Cajilig
(74) *Attorney, Agent, or Firm* — ArentFox Schiff LLP

(57) ABSTRACT

The invention relates to a prefabricated panel for light-weight one-way joist slabs of the compound section type, comprising an upper contributing layer, a lower contributing layer having a series of upper peaks and troughs and shear transfer bolts which secure the upper contributing sheet to the upper peaks of the lower contributing sheet, and shear bolts or pins which secure the lower contributing layers to the slab framework beam. The functioning of the upper and lower contributing layers as a compound section permits the production of a highly efficient system for supporting the requirements of bending and shear forces, having a low unitary weight in comparison to the existing systems, which involves lower loads in terms of its own weight and a reduction in the inertia effects during seismic events, while constituting a less bulky structural solution, having fewer
(Continued)

ground requirements and being much more economical, thereby reducing the time and input, labour and equipment required for the production and assembly thereof.

19 Claims, 8 Drawing Sheets

(51) Int. Cl.
*E04C 2/28* (2006.01)
*E04C 2/32* (2006.01)
*E04C 2/38* (2006.01)

(52) U.S. Cl.
CPC ..... *E04B 2103/02* (2013.01); *E04B 2103/06* (2013.01); *E04C 2/38* (2013.01)

(56) References Cited

U.S. PATENT DOCUMENTS

2002/0088199 A1 7/2002 Linn
2004/0065039 A1* 4/2004 Doppler ..... E04B 5/02 52/578
2008/0289292 A1* 11/2008 Giles ..... E04B 5/02 52/783.11
2009/0151278 A1* 6/2009 Doppler ..... E04B 5/10 52/220.4
2010/0293872 A1* 11/2010 Kennedy ..... E04B 5/02 52/127.6
2011/0067328 A1* 3/2011 Naccarato ..... E04F 11/00 52/182
2012/0317919 A1* 12/2012 Rahimzadeh ..... E04B 1/165 52/655.1
2014/0065349 A1* 3/2014 Kwan ..... E04C 2/049 428/99
2014/0087158 A1* 3/2014 Ciuperca ..... B32B 13/14 428/215
2014/0130435 A1* 5/2014 Paradis ..... B32B 5/18 52/309.12
2016/0040424 A1* 2/2016 Nguyen ..... E04B 1/24 52/220.1
2016/0298327 A1* 10/2016 Thomas ..... E04B 5/04
2016/0369505 A1* 12/2016 Dombowsky ..... E04B 5/43

FOREIGN PATENT DOCUMENTS

CN 204781519 U 11/2015
CO 02-43805 5/2002
CO 5650072 A1 6/2006
FR 2773566 A1 7/1999
WO WO 9509954 A1 4/1995

* cited by examiner

-- RELATED ART --

-- RELATED ART --

-- RELATED ART --

-- RELATED ART --

-- RELATED ART --

PANEL OF COMPOUND SHEETS FOR THE CONSTRUCTION OF LIGHT-WEIGHT ONE-WAY JOIST SLABS

CROSS-REFERENCE TO RELATED APPLICATIONS

This application is a National Stage Entry of International Patent Application No. PCT/IB2017/051709, filed Mar. 24, 2017, which claims priority to Colombian Patent Application No. 16128043 filed May 16, 2016. The entire contents of each of the priority applications are incorporated herein by reference.

FIELD OF TECHNOLOGY

This application pertains to a prefabricated panel for one-way light-weight joist slabs of the compound section type, which combines: an upper contributing layer, a lower contributing layer, and shear bolts or connectors that connect the two components, thereby allowing the panel to operate as a compound section and thereby producing a high-efficiency system for meeting the demands of bending moments and shear forces. Because of the foregoing, these panels have a low per-unit weight compared to existing systems. The foregoing translates into smaller inherent-weight loads and mitigates inertial effects during seismic events, thereby making it possible to use less rugged structural solutions that impose lower demands on the soil and are much more economical. In addition, by eliminating the casting of concrete during the manufacture of the joist slabs, completely in the case of metal structures and significantly in the case of concrete structures, less time and fewer inputs are required: labor and equipment during this activity, thereby reducing cost.

STATE OF THE ART

Construction systems for one-way light-weight slabs, which account for the majority of those produced, include:

Light-weight one-way slabs with blocks or caissons (1), as shown in FIG. 1, which depicts a general cross-section of a slab that is produced using this system. The lightening elements (11) can be: blocks of clay, concrete, or mortar, caissons made of expanded polystyrene (ICOPOR) or guadua [Translator's note: a type of South American bamboo], and in general elements that make up a system with a low specific weight and that can be incorporated into the slab or can be removed after the concrete cures. This system maintains a small separation between the joists (12) or length of the sheet (13), where the separation distance or width (A) of the lightening element along the sheet is between 300 and 800 mm. For a width of the sheet (13) of 50 mm, the per-unit weight of the sheet is 120.0 kg/m$^2$. Managing the smallest separation between joists ensures that the slab: sheet+joists is the solution with the best weight per unit of surface area. This category of joist slab manages per-unit weights within the range of 300-600 kg/m$^2$.

The compound-section system formed by a contributing layer of steel deck+concrete is shown in FIG. 2, which depicts a longitudinal section FIG. 2A and a cross-section of the system FIG. 2B. The contributing layer (21) performs two functions; first as a form for receiving the concrete (22) while it cures, and second, once the concrete has cured, the ridges formed in the layer prevent the concrete from slipping and force it to work therewith in an integral fashion, thus creating a compound system. The maximum gap (B) or separation between joists (23) of this sheet is equal to or less than 2.5 m. The weight of the sheet per square meter varies depending on the height of the concrete and the thickness or size of the contributing sheet or steel deck that are combined. This kind of joist slab keeps per-unit weights between 187.0 kg/m$^2$ and 286.0 kg/m$^2$.

On the national market there is the system: easy sheet, a cross-section which is depicted in FIG. 3. The system consists of "U"-section steel joists (31) which, during the casting of the slab, are filled with concrete, are separated by a gap of 800 mm, and support the "sheet" that is formed with clay blocks (32) having a length (A) of 800 mm and a per-unit weight of 60.0 kg/m$^2$. The addition of a concrete coating (33) measuring 40 mm and electric-welded mesh to the 'sheet' determines its per-unit weight, on the order of 96.0 kg/m$^2$. Assuming that the separation between the "U"-shaped joists (31) is 800 mm, this category of joist slab manages per-unit weights of between 206.0 and 268.0 kg/m$^2$.

This system of prestressed prefabricated alveolar sheets is depicted in FIG. 4. This figure shows a cross-section of one type of this sheet for commercial areas. The system consists of slender prestressed sheets (41) made of high-strength concrete and lightened with internal cavities (42) in the form of tubes. The gaps between these sheets are between 2000 mm and 9500 mm, and their inherent weight is between 135.0 and 215.0 kg/m$^2$. For a concrete slab and assuming support-beam cross-sections of 200×500 mm, the weight per square meter of this category of slab lies between 241.0 and 255.0 kg/m$^2$.

In general, the systems currently in use require in-situ concrete casting, except for prestressed alveolar sheet system. The range of weights per square meter of the slab systems currently in use is between 206.0 and 600.0 kg/m$^2$.

Included herein are patent applications and applications for utility models that make reference to prefabricated floors. This is the case with application CN204781519 (U), which describes a light-concrete sheet with a piece that is prefabricated on-site, in which the lower piece includes a pre-buried truss (frame) and a part made of light concrete. In this application the elements that make up the assembly are molded on-site, including a cap made of regular concrete, with a shape that is adaptable to a floor. This floor comprises a steel bar that makes up the frame uses [sic, should probably be in "used"] in layered profiles; the latter retains a triangular shape. Said profiles are located on the lower part of the prefabricated light-concrete piece. The advantages of this system include: connecting in its entirety ordinary concrete to the light concrete via a steel frame, thereby reducing the weight of the floor. The integrity of the overall unit is increased, and the use of the lower profile makes it possible to protect the light concrete, thus enhancing the load-bearing capacity of the structure and thereby improving the durability of the lightened concrete. However, this system is not only very heavy, but it also requires a complex combination of profiles and frames that have to be installed on-site.

Other prefabricated sheets are cited in the Colombian application 06 018544, which discloses prefabricated concrete sheets for creating flat surfaces for tracks and roads; said sheets comprise a body or volume with a quadrilateral outline and interior metal reinforcement along with some means for connecting to adjacent sheets of the same type. Said means for connecting to adjacent sheets of the same type consist of a metal plate with angular end folds and anchoring screws. These metal plates connect the adjacent sheets like a bridge, with being anchoring screws secured close to their respective shared edges. The system described above focuses on the way in which the prefabricated sheets can be connected. In no way does this system make it possible to reduce the weight of the sheet and retain a variable range of resistance to shearing and compression forces that makes it possible to withstand bending due to turning moments or tendencies to turn that can arise at any time.

The state of the art has also been found to include application CO02-043805, which cites a sheet or slab of concrete with metal reinforcements in its sides and inside of its flat bases with beveled sides and an inside area filled with materials other than concrete, which act as elevations (peaks) of weight and which impart anti-acoustic, anti-thermal, and flame-retardant properties for the multiple uses to which this element is put. Even though this sheet reduces the weight of the system, it is unable to achieve the levels of weight reduction achieved with this patent application, nor does it contribute to shearing and compression forces [sic, one or more words may be omitted].

The state of the art also cites CN201424725, which refers to a prefabricated concrete sheet with a metal section, which comprises a lower sheet of reinforced concrete, an upper sheet of concrete, and two longitudinal concrete bars that are supported between the upper and lower sheets by means of holes arranged on the sides of the longitudinal bars; a sheet on the ground is formed by cutting and joining multiple pieces of prefabricated reinforced-concrete sheets; a steel reinforcing bar extends through holes arranged in the sides of the longitudinal bars in order to connect to the different prefabricated pieces; later, concrete is cast in order to fill and level the hollow cavities formed between the longitudinal bars, thereby reducing the dead weight of the floor sheet and extending its service life.

It has likewise been found that application FR19980000526 refers to a panel that has a sound-absorbing parallelepiped shape (3). The assembly has parallel vertical ribs (30) with a trapezoidal cross-section. The lower face of the connecting section is flat. This construction element is essentially characterized by the fact that it is an essentially rectangular parallelepiped and that it is made up of two parts, a connecting part and a sound-absorbing part, which is located on the sound-emission side and has vertical and parallel thickness ribs with a trapezoidal cross-section, while the upper face of said connecting part is located in the same plane as the upper face of said absorbing part and has a longitudinal recess for receiving the mortar, etc., and the lower face of said connecting piece is located in the same plane as the lower face of said absorbing part, is flat [sic, incomplete or run-on sentence]. This construction element has a part that protrudes from the lateral edge, which has a vertical notch for receiving a compressible joint. In addition, the connecting part comprises at least one wide vertical channel shaft for receiving mortar, etc. in order to ensure the construction of the wall.

Considering the foregoing, it is clear that it is necessary to develop a system that offers the features that the above-cited systems currently provide but that is lighter in weight, meaning lower transportation costs, less stringent requirements as regards the effect of inertial loads during seismic events, is less rugged, puts less stress on the ground, and ultimately provides more economical cementing solutions.

Likewise, an effort is made to ensure that the system is prefabricated in order to eliminate the need to cast concrete and use bracing devices, thereby reducing cost, labor, and installation time.

DETAILED DESCRIPTION OF THE PRESENT INVENTION

Figure 1:
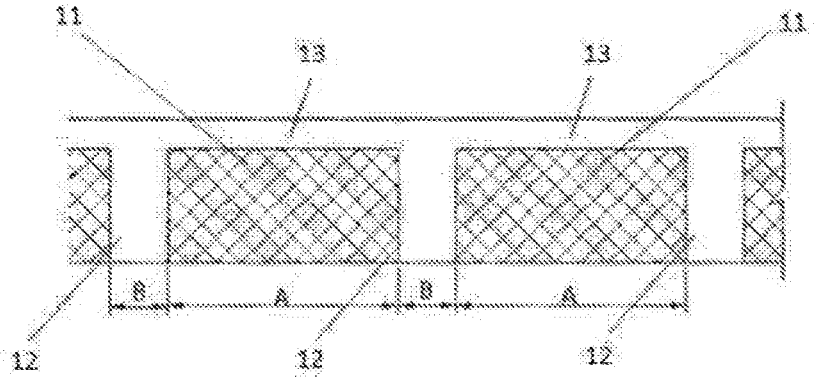
FIG. 1 shows a schematic section of a one-way slab lightened with blocks or caissons.
Figure 2A:
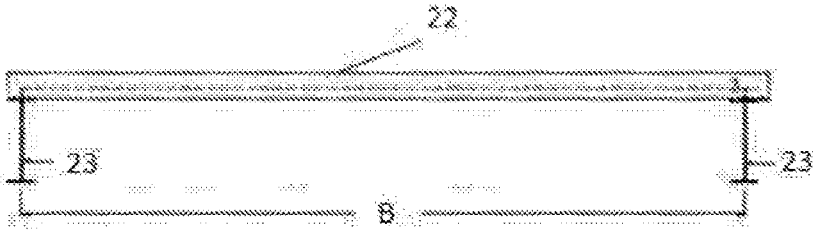
FIG. 2A shows a longitudinal section of a system with a compound section.
Figure 2B:
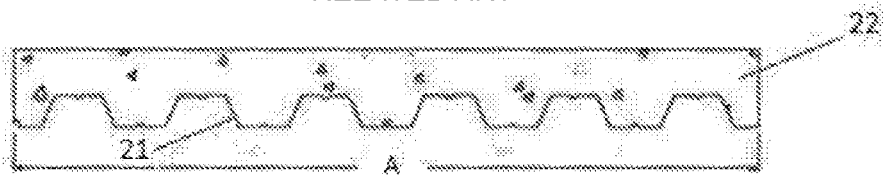
FIG. 2B shows a cross-section of a compound-section system.
Figure 3:
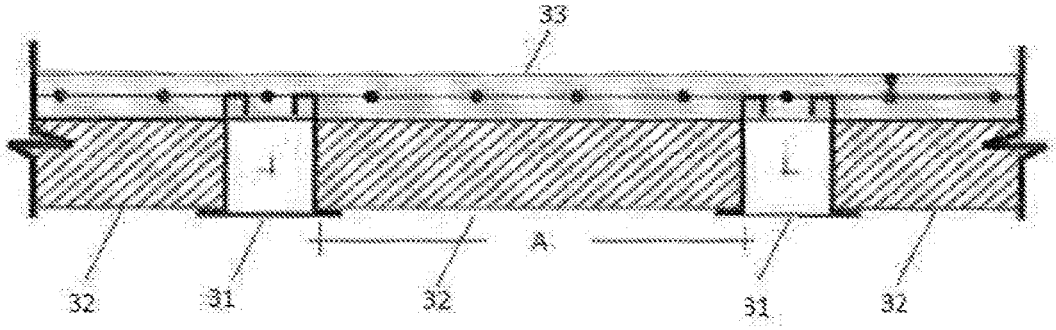
FIG. 3 depicts the elements that make up the easy-sheet system.
Figure 4:
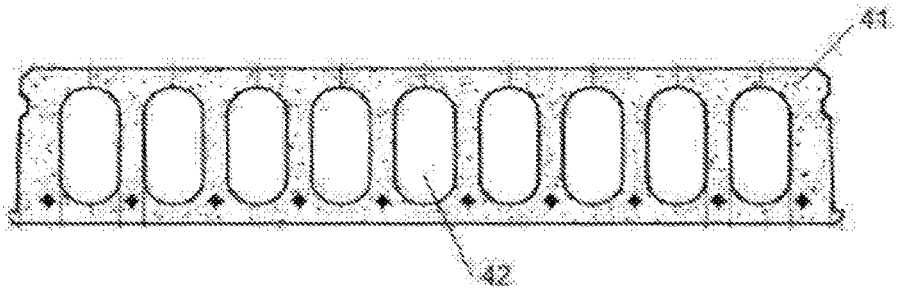
FIG. 4 shows a system of prestressed alveolar prefabricated sheets.
Figure 5:
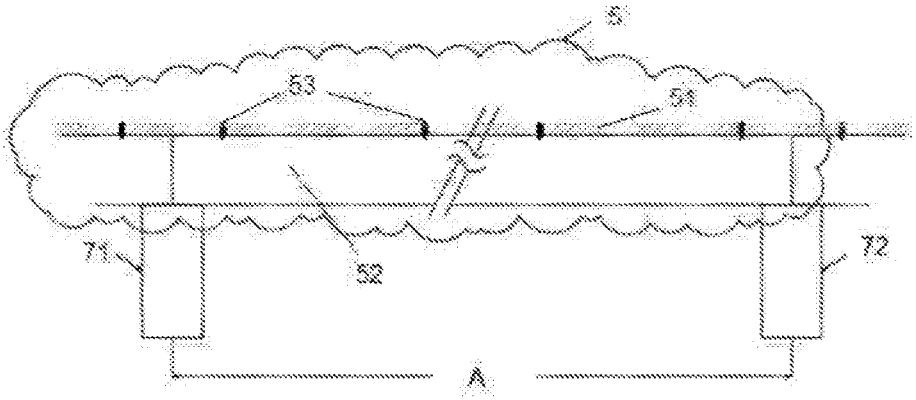
FIG. 5 shows the longitudinal section of the compound-sheet panel (5) in accordance with this patent application.

The compound-sheet panel (5) of this invention was designed as a prefabricated panel for the field of sheets made of one-way light-weight slabs. As FIG. 5 shows, said panel is composed of an upper layer (51) of the cement type and/or polymer resins, cured, with thicknesses of between 15 and 20 mm, a compressive strength of between 27 Mp and 28 Mp, and a specific weight of between 1550.0 and 1600.0 $kg/m^3$; hereinafter this layer will be referred to as the upper contributing layer (51), and a lower contributing layer (52) made of cool-roll (CR) steel, which is among the references described in section A.3.1 of standard AISI 1996 and which has a thickness of 0.6-1.2 mm, or which is made of cold-rolled stainless steel having a thickness of between 0.5 and 0.8 mm.

Figure 6:
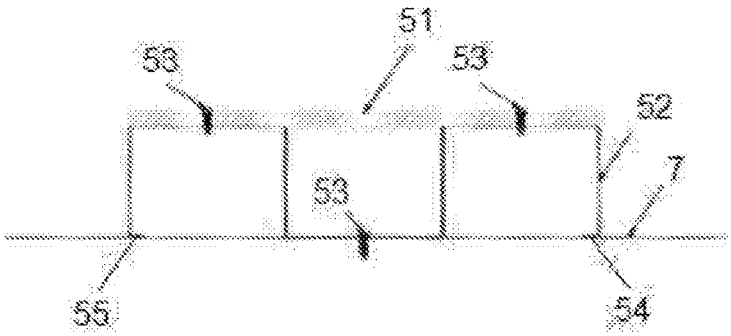
FIG. 6 shows the cross-section of the compound-sheet plate (5) in accordance with this patent application.

The cross-section of said panel is depicted in FIG. 6, which shows that the lower contributing layer (52) features a series of upper peaks (521) and valleys (522). The upper contributing layer (51) is secured by shear bolts or pins (53) working in shear and compression on the upper peaks (521) of the lower contributing layer (52), while the valleys (522) are connected by means of shear bolts or pins (53) to the slab (7) lattice beam, which can be made of steel or concrete. In this system, the shear bolts or pins (53) take up the shear stresses that are generated by the integrated operation of the system under shearing conditions.

Figure 7:
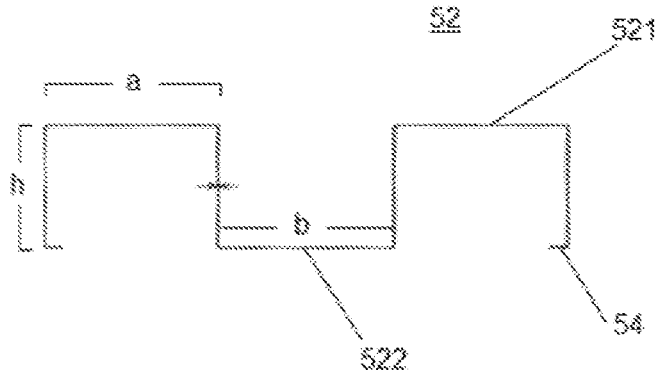
FIG. 7 shows in detail the characteristics of the lower contributing layer (52) of the sheet panel of this application.

The selection of the lower contributing layer (52) is subject to the AISI standard, and its dimensions will vary depending on the requirements as regards loads and separation between supports. FIG. 7 depicts the lower contributing layer (52) in detail and independently. As can be seen, said layer includes the peaks (521), which have a width (h) that varies between 100 and 150 mm, a width (a) of 185-250 mm, a peak-to-peak distance (b) of between 190 and 260 mm, and which have at each of the ends of the lower contributing layer (52) a horizontal flange (54) whose length is 20 mm.

By contrast, the selection of the upper contributing layer (51) will be determined by resistance to compression and shearing stresses according to the LRFD [Load and Resistance Factor Design] design method, standard ACI. Both contributing components (51, 52) must comply with verification of [Translator's note: this should perhaps be "guarantee resistance to"] the compression stresses generated by the shear bolts or pins (53).

Figure 8:
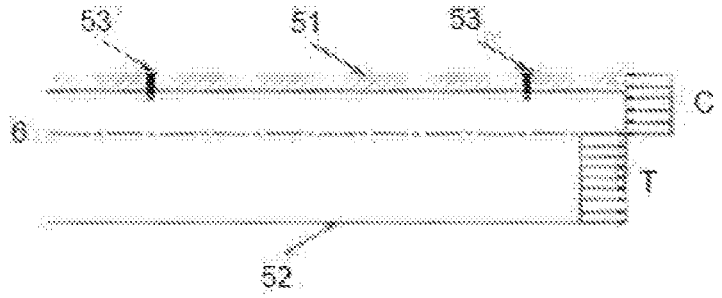
FIG. 8 depicts the internal distribution of last-minute stresses in the longitudinal section of the compound-sheet panel in accordance with this application.

Under the action of loads distributed over the upper contributing layer (51), the internal stresses of the sheet panel (5) exhibit the behavior of a sheet with a length/width ratio of >3, where said stresses resemble the behavior of a wide beam; this makes it possible to assume that there exists a distribution of similar internal stresses: as shown in FIG. 8, the forces of strain (T) are taken up by the lower contributing layer (52), and the majority of the compression (C) stresses are taken up by the upper contributing layer (51). This figure also shows the neutral axis (6), which is located between the compression (C) stresses and the strain (T) forces.

The sheet panel of this invention is conceived of as prefabricated and operating under conditions of simple support, on the system of beams of the slab (7), where the panel is secured to the beams by means of attachments or shear connectors consisting of fired bolts and/or nails, joining the lower contributing layer (52) to the upper face of the support beam (7), which is made of concrete or steel. The inherent weight of the panel varies between 40.0 and 48.0 kg/m$^2$. For a concrete slab, assuming support-beam cross-sections of 150×400 mm, the weight per square meter of this slab system is between 108.0 and 116.0 kg/m$^2$.

EXAMPLES: STRUCTURAL DETAILS

Figure 9:
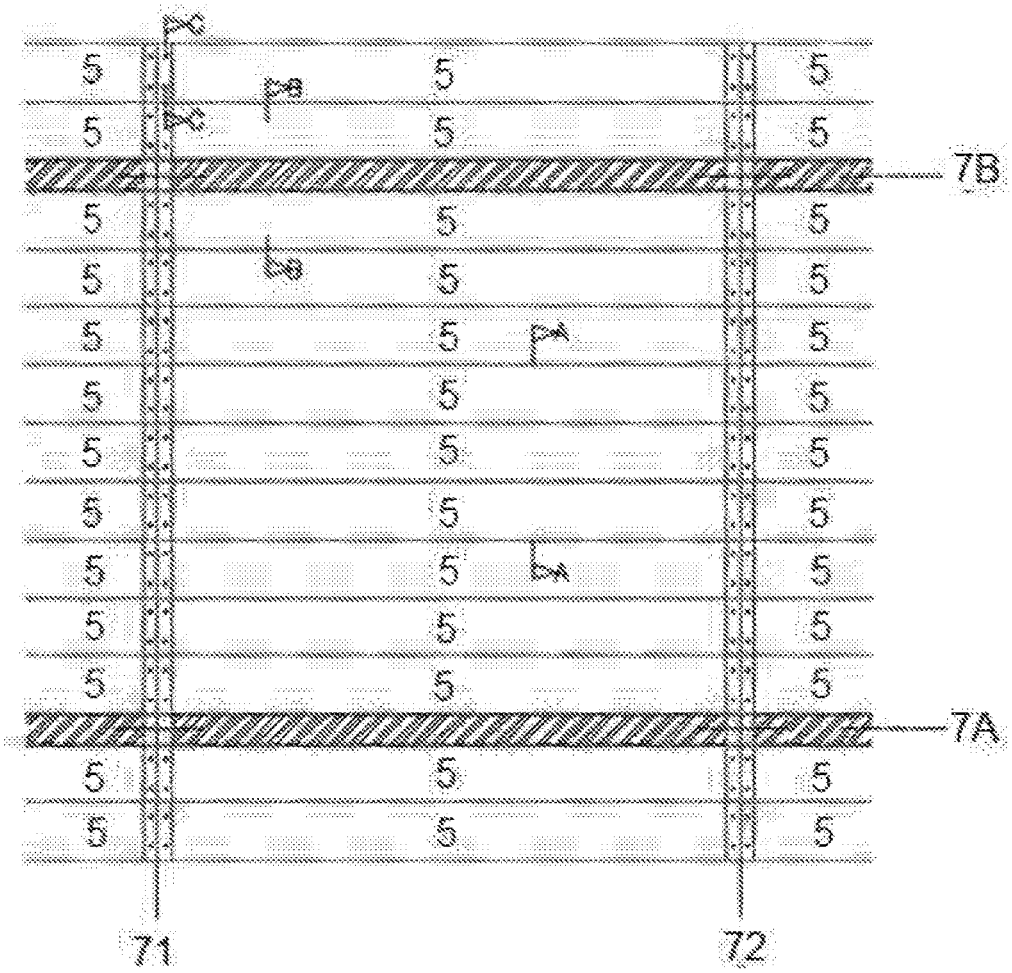
FIG. 9 depicts a schematic of the arrangement of the sheet panels (5) over the lattice of beams (7) that comprise the system that constitutes the slab.

Example 1. Arrangement of the Sheet Panels (5) on the Lattice of Beams (7) of the Slab The arrangement of the panels (5) of this invention on the lattice of beams (7) is depicted in FIG. 9 for the purpose of forming a system that makes up the slab. Once the sheet panel (5) has been selected based on the requirements of gaps and loads, it is put in place simply resting on the beams (7) of the slab lattice, midline to midline of the beams, working on a single gap. Said beams (71, 72, 7A, 7B) are crossed, forming a grid.

Figure 10:
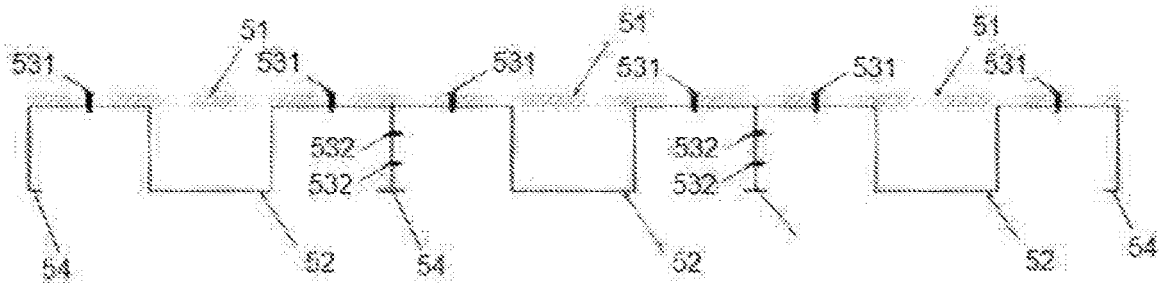
FIG. 10 shows the section A-A of FIG. 9, in which the positioning of the bolts in the sheet and in the beams is depicted.

The integrated working of the set of panels (5) as a system of flat beams is achieved by virtue of the fact that the shear bolts or pins (53) depicted in FIG. 10 work on shear: "Section A-A FIG. 9". The shear bolts or pins (531) guarantee the transfer of shear forces in order to ensure integral operation between the upper contributing layer (51) and the lower contributing layer (52), while the shear bolts or pins (532) are responsible for transferring shear forces in order to guarantee integral operation between sheet panels (5), thereby avoiding cracks between joints. These shear bolts or pins (532) keep different levels of deflection from arising along the longitudinal lines that delimit the panels (5), thereby preventing the floor finishes from cracking along said lines.

Example 2. Treatment of Intermediate Beams (7A, 7B) that are Parallel to the Sheet Panels (5)

Figure 11:
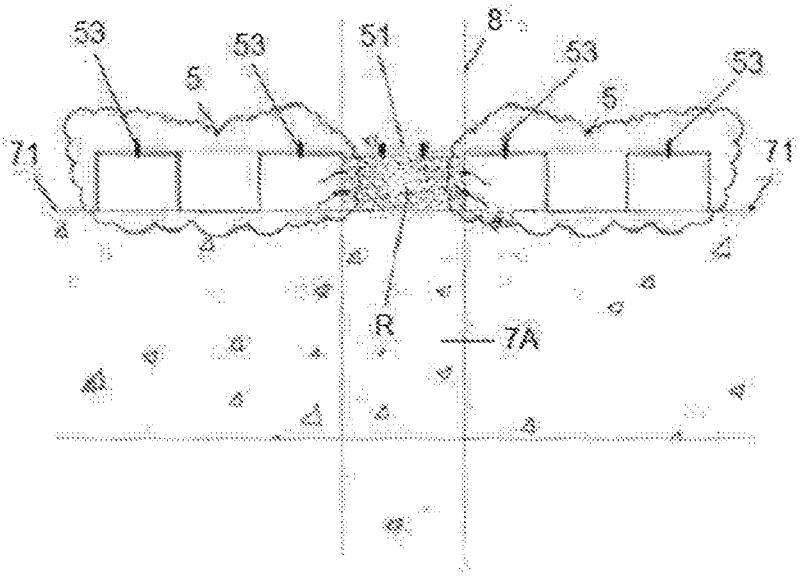
FIG. 11 shows the section B-B of FIG. 9, in which the leveling treatment for the central beam is depicted.

As regards the treatment of the intermediate beams (7A, 7B), which are parallel to the plate panels, said beams are shown in FIG. 11, which depicts a section B-B of FIG. 9. The leveling treatment of the central beam (7A) is carried out with a concrete f'c=10 Mp to accommodate the floor finish. The sheet panels (5) that confine the filler would act as skirts. Later and once the filler (R) has hardened, the skids of the lower contributing layer (52) that push against it are secured with appropriately selected shear bolts or pins (53) (bolts of Type A490 for metal beams or epoxy fasteners or fired nails for concrete beams). FIG. 11 also shows the column (8) that rises above the sheet panel (5) at the point where the central beam (7A) and the support beam (71) come together.

Example 3. Treatment of Support Beams (71, 72) that are Perpendicular to the Sheet Plates (5)

Figure 12:
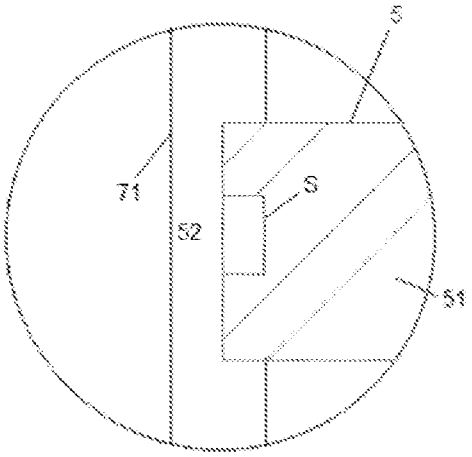
FIG. 12 shows a detail of the attachment of the sheet panel (5) in the support beam (71, 72) by means of bolts working in shear.
Figure 13:
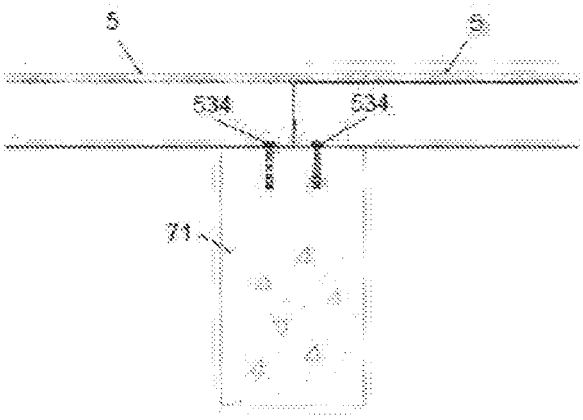
FIG. 13 shows the section C-C, in which a different point of view of the attachment of the sheet panel (5) in the support beam (71, 72) is depicted.

The way in which the plate panel of this patent application (5) and the support beams (71, 72) interact is presented in FIG. 12. In this figure a cut (S) is shown that is made in the upper contributing layer (51) along the edge that strikes against the central axis of the support beam (7) for the purpose of securing the central valley (522) of the lower contributing layer (52) to the support beam (71, 72) by means of shear bolts or pins (534) that are appropriately selected (bolts of Type A490 for metal structures, or epoxy fastening s for concrete structures) as shown in FIGS. 12 and 13. Once the attachment is made, the opening that has been made (S) is again closed with the epoxy resin, thereby securing the cut segment.

Example 4. Treatment of Joints Along the Centerlines of the Support Beams (71, 72)

Figure 14:
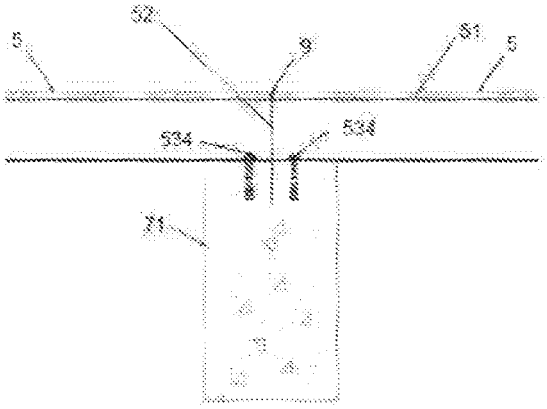
FIG. 14 shows the section C-C, in which the filler (9) with a high modulus of elasticity along the central joint of the support beam (71, 72) is depicted.

The split center joints along the support beams (71, 72) are sealed with a joint filler (9) with a high modulus of elasticity, such as Sikabond T2 or the like (see FIG. 14).

Example 5. Fire Protection

To produce fire-resistant panels (5), a fire-resistant coating is applied to the lower face of the lower contributing layer; this coating guarantees that the coating will remain stable for at least 120 minutes after a fire starts.

Analytic Basis of the Behavior

The plate panel (5) of this invention is made up of three components:

Upper contributing layer (51): cement-type and/or polymer resin sheet with thicknesses of between 15 and 20 mm, autoclave-cured, with a compressive strength of greater than 27 Mp and a specific weight of between 1200.0 and 1600.0 kg/m$^3$. It is selected in accordance with standard ACI318 11 by the LRFD [load and resistance factor design] method.

Lower contributing layer (52): made of CR steel with a trapezoidal cross-section within the references described in section A.3.1 of standard AISI 1996 and having thicknesses of between 0.6 and 1.2 mm, or cold-rolled stainless steel with thicknesses of 0.5-0.8 mm. The selection thereof is made in accordance with standard AISI 3. It is recommended that the Finite Elements Method be used for the analysis of the flat components of the system, the upper contributing layer (51), and the lower contributing layer (52). Shear transfer bolts (53). Among these components there exist the following categories, which are illustrated in FIGS. 10 and 11; they are:

Shear bolts or pins (531) work on transferring shear forces between the upper contributing layers (51) and the lower contributing layer (52).

Shear bolts or pins (532) work on transferring shear forces between lower contributing layers (52).

These bolts are of the following type: matchtip Phillips milled-head screw with a diameter of at least 5.5 mm; selection thereof is made in accordance with standard ASIC-LRFD.

Considering the panel (5) defined above, the applicant has analyzed its behavior and has determined that said panel and the system that includes it offer the following advantages:

Lower weight per square meter of the system:

Inherent weight 40.0-48.0 kg/m$^2$. For a concrete slab and assuming support beam (71, 72) cross-sections of 150×400 mm, the weight per square meter of this slab system is within the range: 108.0-116.0 kg/m$^2$.

Compared to the existing lighter composite cross-section system, contributing layer+concrete, which has a slab weight range of 187.0-286.0 kg/m$^2$ [sic, incomplete sentence].

These data make it clear that the system based on the panel (5) of this application provides a reduction in weight of between 42.2% and 59.4% dead load per slab. This significant reduction in the inherent weight of the slabs means: lower demands on the structure due to gravitational loads and consequently lower cost for the structure, lower requirements due to the effects of inertial loads during seismic events, and consequently less rugged structural solutions and, finally, lower costs as well as less load on the ground and therefore lower-cost cementing solutions.

Ease of Execution of the Slab Item

Since this is a prefabricated system, the activity of concrete casting is eliminated, thereby transforming the operation into the installation of a low-weight system, which translates into fewer resources required for the execution of the item or lower costs and shorter execution times.

Likewise, the sheet panel enhances the moment of inertia of the section by putting the center of gravity closer to that of the upper contributing layer.

Immediate load-bearing capacity. As a result, the requirement for shoring equipment is eliminated, meaning lower costs for this design.

Speed of Putting the Slab into Service

Since this is a prefabricated system, it is available immediately, making it possible to initiate finishing activities sooner.

The invention claimed is:

1. A prefabricated sheet panel for the manufacture of concrete slabs, comprising:

an upper contributing layer, comprised of at least one of a cement or polymer resin;

a lower contributing layer, formed of a single piece of metal, including:

a series of upper surfaces; and at least one lower surface with walls connecting the upper surfaces and lower surface, wherein the upper surfaces and at least one lower surface form peaks and valleys in the lower contributing layer, wherein the walls are perpendicular to the upper contributing layer and the upper surfaces and lower surfaces, the lower contributing layer having a first end and a second end, the first end and the second end each having a horizontal flange that folds inwards toward the center of the panel;

a first series of shear transfer bolts or pins that secure the upper contributing layer to each one of the upper surfaces of the lower contributing layer; and a second series of shear transfer bolts or pins that are configured to connect the sheet panel to a second sheet panel or to a support beam via the walls at the first end and the second end of the lower contributing layer.

2. The panel in accordance with claim 1, wherein the upper contributing layer is made of a cement material combined with a thermostable polyester resin.

3. The panel in accordance with claim 1, wherein the upper contributing layer has a thickness of 15-20 mm, a compressive strength of 27-28 MPa, and a specific weight of 1550.0-1600.0 kg/m$^3$.

4. The panel in accordance with claim 1, wherein the lower contributing layer is a layer of cold-rolled steel that has a thickness of 0.6-1.2 mm or cold-rolled stainless steel whose thickness is between 0.5 mm and 0.8 mm.

5. The panel in accordance with claim 1, wherein the peaks have a height (h) that varies between 100 and 150 mm, a width (a) of 185-250 mm, and a peak-to-peak distance (b) of 190-260 mm.

6. The panel in accordance with claim 1, wherein the horizontal flanges, which are located at the first end and the second end of the lower contributing layer, are 20 mm in length.

7. The panel in accordance with claim 1, wherein the weight of the panel weight varies between 40.0 and 48.0 kg/m$^2$.

8. A slab construction system, that comprises sheet panels in accordance with claim 1 supported on slab beams.

9. The slab construction system in accordance with claim 8, wherein the lower contributing layers of the sheet panels are secured to an upper face of a support beam via the second series of shear transfer bolts or pins, wherein the second set of transfer bolts or pins comprise bolts or pins or fired nails.

10. The slab construction system in accordance with claim 8, wherein the slab beams are made of steel or concrete.

11. The slab construction system in accordance with claim 8, further comprising intermediate beams, which are parallel to the sheet panels, and support beams, which are perpendicular to the sheet panels.

12. The slab construction system in accordance with claim 11, wherein the support beams intersect, forming a grid.

13. The slab construction system in accordance with claim 8, wherein a plurality of columns rise above the sheet panel at the point where a central beam and the support beams come together.

14. The slab construction system in accordance with claim 8, wherein the sheet panels are joined to the support beams by shear bolts or pins or fired nails that run through a cut in the upper contributing layer, where said cut is located along an edge that abuts a central axis of the support beam and makes it possible for a central valley of the lower contributing layer to be secured to the support beams.

15. A slab construction system comprising:

a plurality of sheet panels, each of the plurality of sheet panels including:

a prefabricated sheet panel for the manufacture of slabs, characterized by the fact that it includes an upper contributing layer, a lower contributing layer, which has a series of upper peaks and valleys with walls that are perpendicular to the upper contributing layer, the upper contributing layer having a first end and second end, the first end and the second end each having a horizontal flap that folds toward the center of the panel; and shear transfer bolts that secure the upper contributing layer to the upper peaks of the lower contributing layer, and shear transfer bolts or pins that interconnect the sheet panel via the peaks of the first and second ends of its lower contributing layers or secure the lower contributing layers to a support;

wherein at least one of the sheet panels is joined to support beams via a plurality of shear bolts or pins or fired nails that run through a cut in the upper contributing layer, where said cut is located along an edge that abuts a central axis of the support beam and makes it possible for a central valley of the lower contributing layer to be secured to the support beams; and wherein the cut in the slab construction system is covered by a fragment removed to create the cut and wherein that the fragment is attached with epoxy resin.

16. The slab construction system in accordance with claim 8, wherein central joints, which are distributed along the support beams, comprise a joint filler with a high modulus of elasticity.

17. The slab construction system in accordance with claim 8, wherein a lower face of the lower contributing layer has a fire-resistant coating.

18. The slab construction system in accordance with claim 17, wherein the fire-resistant coating comprises a ceramic-particle paint.

19. A prefabricated building construction panel, comprising:

an upper contributing layer, the upper contributing layer having a first extending planar upper surface on a first side and a second extending planar lower surface on a second side opposite the first side; and a lower contributing layer formed of a single piece of metal, the lower contributing layer including:

a plurality of peak portions, each of the plurality of peak portions having an upper extending planar surface with a first end and a second end, each of the upper extending planar surfaces of the peak portions extending in directions parallel to one another;

a plurality of connecting portions, each of the plurality of connecting portions having at least one extending planar surface with a first end and a second end, each of the plurality of connecting portions extending from the first end to one of the first end or the second end of one of the plurality of peak portions, each of the at least one planar surfaces of each of the plurality of connecting portion extending in directions perpendicular to the directions of extension of each of the extending planar surfaces of the plurality of peak portions;

at least one valley portion, each of at least one valley portion having a lower extending planar surface with a first end and a second end, each of the lower extending planar surfaces of the at least one valley portion extending in directions parallel to each of the upper extending planar surfaces of the peak portions; wherein each of the at least one valley portion is connected to the second end of at least one of the plurality of connecting portions via the second end of the connected portion; and a first flange having a first flange extending planar surface with a first flange first end and a first flange second end, the first flange extending planar surface of the first flange extending in directions parallel to each of the extending planar surfaces of the peak portions; wherein the first flange is connected via the first flange first end to an end of the first of the plurality of connecting portions;

a second flange, having a second flange extending planar surface with a second flange first end and a second flange second end, wherein the second flange extending planar surface of the second flange extends in directions parallel to each of the extending planar surfaces of the peak portions; wherein the second flange is connected via the second flange first end to a second of the plurality of connecting portions;

a plurality of first shear transfer bolts connecting the upper contributing layer to the lower contributing layer via each one of the upper extending planar surfaces of the plurality of peak portions; and a plurality of second shear transfer bolts provided for connecting the at least one of the first or second of the plurality of connection portions to a support beam.

* * * * *